US009469010B2

(12) United States Patent
Barnes et al.

(10) Patent No.: US 9,469,010 B2
(45) Date of Patent: Oct. 18, 2016

(54) BURNISHING UNIT

(71) Applicant: Honda Motor Co., Ltd., Tokyo (JP)

(72) Inventors: Bradley J. Barnes, Anniston, AL (US); Greg F. Brannon, Jacksonville, AL (US)

(73) Assignee: Honda Motor Co., Ltd., Tokyo (JP)

( * ) Notice: Subject to any disclaimer, the term of this patent is extended or adjusted under 35 U.S.C. 154(b) by 484 days.

(21) Appl. No.: 14/192,951

(22) Filed: Feb. 28, 2014

(65) Prior Publication Data

US 2014/0259583 A1 Sep. 18, 2014

Related U.S. Application Data

(60) Provisional application No. 61/782,805, filed on Mar. 14, 2013.

(51) Int. Cl.
*B24B 39/00* (2006.01)
*B24B 5/42* (2006.01)

(52) U.S. Cl.
CPC . *B24B 5/42* (2013.01); *Y10T 29/47* (2015.01)

(58) Field of Classification Search
CPC ..... B24B 5/42; Y10T 29/47; Y10T 29/4968
USPC ..... 29/90.01, 6.01, 89.5
See application file for complete search history.

(56) References Cited

U.S. PATENT DOCUMENTS

| | | | | |
|---|---|---|---|---|
| 1,961,304 | A * | 6/1934 | Edouard | F16C 33/14 29/898.059 |
| 2,915,809 | A * | 12/1959 | Egger, Jr. | B24B 5/42 29/90.01 |
| 4,458,926 | A | 7/1984 | Williamson | |
| 5,076,616 | A | 12/1991 | Williamson | |
| 6,257,037 | B1 | 7/2001 | Lonero et al. | |
| 7,032,934 | B2 | 4/2006 | Wosik | |
| 2005/0198793 | A1 | 9/2005 | Ueda | |
| 2011/0127771 | A1 | 6/2011 | Panusa | |

FOREIGN PATENT DOCUMENTS

| | | |
|---|---|---|
| EP | 2046530 | 4/2009 |

* cited by examiner

*Primary Examiner* — Jason L Vaughan
*Assistant Examiner* — Amanda Meneghini
(74) *Attorney, Agent, or Firm* — Rankin, Hill & Clark LLP

(57) ABSTRACT

A burnishing unit includes a housing having a bore extending therethrough. The bore has a first end portion and a second end portion. A first fluid port and a second fluid port are provided on the housing, each fluid port is in communication with the bore. The first fluid port introduces hydraulic fluid to the bore and the second fluid port allows hydraulic fluid to escape from the bore. A removable sleeve is positioned in one of the first end portion and second end portion of the bore. The sleeve includes a sidewall having an opening in communication with the bore and the first fluid port. A hydraulic fitting positioned in the first fluid port has a proximal end portion adapted to receive a hydraulic conduit and a distal end portion. The distal end portion is adapted to sealingly engage the sidewall of the sleeve around the opening provided therein.

20 Claims, 5 Drawing Sheets

BURNISHING UNIT

BACKGROUND

Various machines and methods have been employed to strengthen and finish metal work pieces such as crankshafts and camshafts for internal combustion engines. In many modern vehicles, engines have been downsized and, with the downsizing of vehicles and their components for reducing weight and improving fuel efficiency, smaller engines and crankshafts are often used. To improve the fatigue strength and durability of these crankshafts, deep rolling of fillets and other circular joint areas is increasingly important. The fatigue strength and durability of crank pins and main bearing journals can be significantly increased by deep rolling compressive stresses into the middle of the annular fillets between the pin journals and adjacent counter weights or balancing webs. In previously designed tool mechanisms for deep rolling machines, the burnishing units which hold the working rollers during the deep rolling operation are subjected to significant wear and tear. This wear on a burnishing unit can lead to surface imperfections in a bore of the burnishing unit, which, in turn, can cause loss of hydraulic pressure and improper functioning of the deep rolling tool.

BRIEF DESCRIPTION

In accordance with one aspect, a burnishing unit comprises a housing including a bore extending therethrough. The bore has a first end portion and a second end portion. A first fluid port and a second fluid port are provided on the housing, each fluid port is in communication with the bore. The first fluid port introduces hydraulic fluid to the bore and the second fluid port allows hydraulic fluid to escape from the bore. A removable sleeve is positioned in one of the first end portion and second end portion of the bore. The sleeve includes a sidewall having an opening in communication with the bore and the first fluid port. A hydraulic fitting is positioned in the first fluid port. The fitting has a proximal end portion adapted to receive an associated hydraulic conduit and a distal end portion. The distal end portion is adapted to sealingly engage the sidewall of the sleeve around the opening provided therein.

In accordance with another aspect, a burnishing unit comprises a housing including a bore extending therethrough. The bore has a first end portion and a second end portion. A first fluid port and a second fluid port are provided on the housing, each fluid port is in communication with the bore. The first fluid port introduces hydraulic fluid to the bore and the second fluid port allows hydraulic fluid to escape from the bore. A first removable sleeve is positioned in the first end portion of the bore. The first sleeve includes a first sidewall having a first opening in communication with the bore and the first fluid port. A second removable sleeve is positioned in the second end portion of the bore. The second sleeve includes a second sidewall having a second opening in communication with the bore and the second fluid port. A hydraulic fitting is mounted in the first fluid port. The fitting has a proximal end portion adapted to receive an associated hydraulic conduit and a distal end portion having an end face. The end face of the distal end portion is adapted to sealingly engage the first sidewall of the first sleeve around the first opening provided therein to prevent leakage of hydraulic fluid between an exterior of the sleeve and the bore.

In accordance with yet another aspect, a burnishing unit comprises a housing including a bore extending therethrough. The bore has a first end portion and a second end portion. A first fluid port and a second fluid port are provided on the housing, each fluid port is in communication with the bore. The first fluid port introduces hydraulic fluid to the bore and the second fluid port allows hydraulic fluid to escape from the bore. A removable sleeve is positioned in one of the first end portion and second end portion of the bore. The sleeve includes a sidewall having a cutout defined by an inwardly extending peripheral wall and a substantially planar base wall. An opening is located on the base wall, and is in communication with the bore and the first fluid port. The sleeve further includes an annular flange having a first indicator and the housing includes a corresponding second indicator. Alignment of the first and second indicators aligns the sleeve opening with the first fluid port. A hydraulic fitting has a hexagonally shaped wrenching proximal end portion having an internal pipe thread for an associated hydraulic conduit and a distal end portion having an external thread for mounting the fitting in the first fluid port. The distal end portion has an end face including an annular groove adapted to at least partially receive an annular seal therein. The end face of the distal end portion is adapted to sealingly engage the base wall of the sleeve around the opening to prevent leakage of hydraulic fluid between an exterior of the sleeve and the bore.

DETAILED DESCRIPTION

It should, of course, be understood that the description and drawings herein are merely illustrative and that various modifications and changes can be made in the structures disclosed without departing from the present disclosure. In general, the figures of the exemplary burnishing unit are not to scale. It will also be appreciated that the various identified components of the exemplary burnishing unit disclosed herein are merely terms of art that may vary from one manufacturer to another and should not be deemed to limit the present disclosure.

Figure 1:
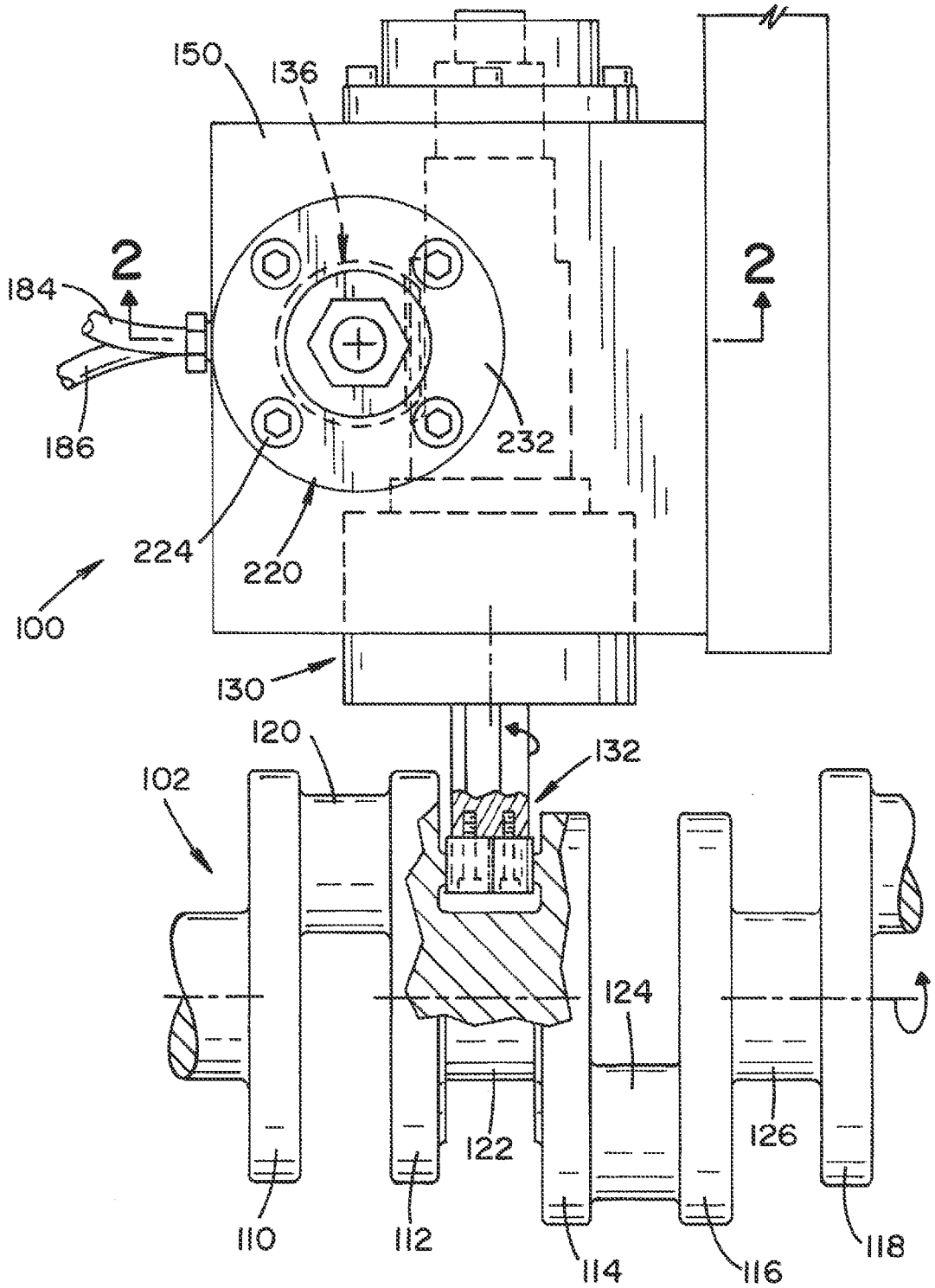
FIG. 1 (PRIOR ART)
FIG. 1 is a schematic view, partially broken away, of a known burnishing unit of a deep rolling machine with working rollers rolling a crankshaft.
Figure 2:
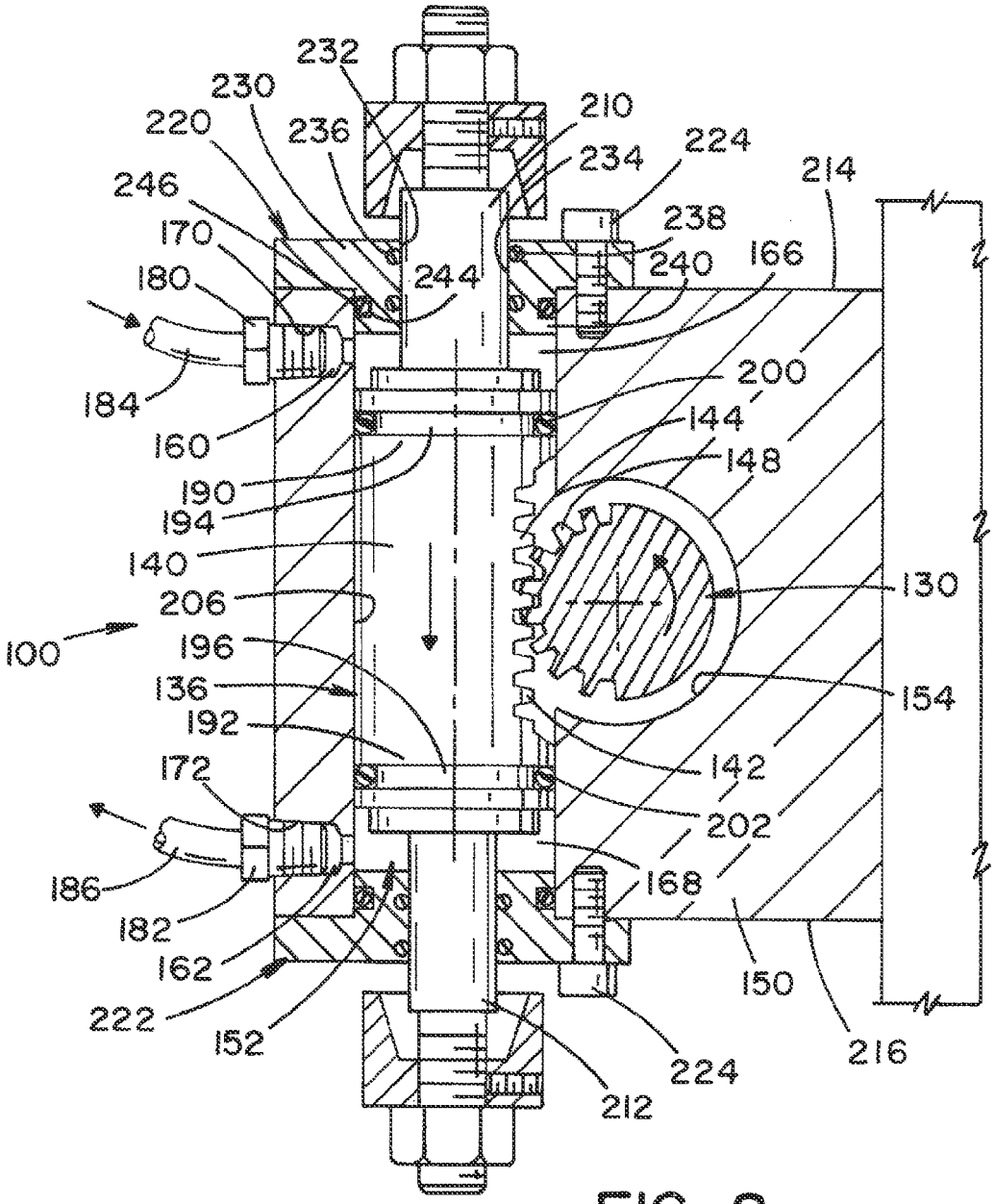
FIG. 2 (PRIOR ART)
FIG. 2 is a cross-sectional view of the burnishing unit of FIG. 1 taken along line 2-2 of FIG. 1.

Referring now to the drawings, wherein like numerals refer to like parts throughout the several views, FIGS. 1 and 2 illustrate a known burnishing unit 100 for use with a deep rolling machine (not shown) to strengthen and finish metal work pieces such as a crankshaft 102 for an internal combustion engine. As is well known, the crankshaft 102 includes a plurality of crank webs or counterweights provided between the opposed ends of the crankshaft. Adjacent crank webs are in spaced relation via one of a main journal and a crank pin journal. Particularly, the portion of the crankshaft 100 depicted in FIG. 1 includes crank pin journal 120 located between crank webs 110, 112; main journal 122 located between crank webs 112, 114; crank pin journal 124 located between crank webs 114, 116; and main journal 126 located between crank webs 116, 118. As indicated above, the fatigue strength and durability of the crankshaft 102 can be significantly increased by deep rolling compressive stresses into annular fillets of the main journals and crank pin journals adjacent the crank webs. To this end, the burnishing unit 100 houses a tool 130 having working rollers 132 for rollingly pressing a section of the crankshaft 102 to be burnished, such as main journal 122. The work rollers 132 are rotated via a piston or slide member 136 which is hydraulically displaceable in the direction indicated by the slide member arrow in FIG. 2 generally against the spring forces of pressure control springs (not shown) that bias the working rollers 132 in an opposite direction. Particularly, the slide member 136 includes a body 140 having an engaging section 142 including a plurality of teeth 144. The teeth 144 mesh with corresponding teeth 148 provided about an outer periphery of a portion of the tool 130. The introduction of hydraulic fluid to the burnishing unit (as described below) displaces the slide member 136 and this movement of the slide member 136 rotates the tool 130 in a first direction (indicated by the tool arrow of FIG. 2). The pressure control springs (not shown) then displace the slide member 136 in the opposite direction causing the tool to rotate in a second direction.

With particular reference to FIG. 2, the burnishing unit 100 comprises a housing 150 including a first bore 152 extending therethrough along a first axis and a second bore 154 extending therethrough along a second axis that is transverse to the first axis. As shown, the slide member 136 is positioned in the first bore 152 and the tool 130 is positioned in the second bore 154, with a portion of the first bore 152 being in communication with a portion of the second bore 154 in an area of the housing 150 where the slide member 136 engages the tool 130. The housing 150 further includes a first fluid port 160 and a second fluid port 162 spaced from the first fluid port. The first fluid port is in communication with a first end portion 166 of the first bore 152 and the second fluid port is in communication with a second end portion 168 of the first bore 152. The first fluid port 160 introduces hydraulic fluid to the first bore 152 and the second fluid port 162 allows hydraulic fluid to escape from the first bore. As shown, each of the first and second fluid ports 160, 162 is at least partially defined by an inner surface 170, 172, respectively. Each inner surface 170, 172 is flared outwardly from the first bore 152 and is provided with a pipe thread which allows a conventional hydraulic fitting 180, 182 connected to a respective hydraulic fluid line 184, 186 to be threadedly inserted from the exterior of the burnishing unit housing 150 into the first and second fluid ports 160, 162. With the use of the conventional fittings 180, 182, a distal end of each fitting is spaced from the first bore 152.

As indicated previously, the introduction of hydraulic fluid into the first bore 152 displaces the slide member 136 which, in turn, rotates the tool 130. With continued reference to FIG. 2, provided at opposite end portions 190, 192 of the body 140 of the slide member 136 are respective annular grooves 194, 196 having seals 200, 202 mounted therein. The seals 200, 202 sealing engage an inner surface 206 of the housing 150 which defines the first bore 152. Shafts 210, 212 project outwardly from the respective end portions 190, 192 and project from opposite sides 214, 216 of the housing 150. The shafts 210, 212 extend through respective end caps 220, 222 which are attached to the sides 214, 216 of the housing 150 via fasteners 224. The end caps 220, 222 cover the respective first and second end portions 166, 168 of the first bore 152. Particularly, end cap 220 comprises body 230 having an opening 232 extending therethrough. The opening 232 is sized to receive the shaft 210. An inner surface 234 of the body 230 that defines the opening 232 includes at least one annular groove 236 having a seal 238 received therein for sealingly engaging an outer surface of the shaft 210. The body 230 further a stem 240 dimensioned to be received in the first end portion 166 of the first bore 152. The stem 240 is provided with an annular groove 244 having a seal 246 mounted therein for sealingly engaging the inner surface 206 of the first bore 152. The end cap 222 has a construction similar to end cap 220.

As indicated previously, the burnishing unit 100 which holds the working rollers 130 during the deep rolling operation is subjected to significant wear and tear. This wear on a burnishing unit 100 can lead to surface imperfections on the inner surface 206 of the first bore 152, which, in turn, can damage the seals 200, 202 and cause loss of hydraulic pressure and improper functioning of the deep rolling tool 130. The present disclosure provides a burnishing unit 300 having improved reliability as compared to the known burnishing unit 100. Similar to burnishing unit 100, burnishing unit 300 houses the slide member 136 deep and a portion of the rolling tool 130. Again, the tool 130 is rotated via the slide member 136 (indicated by the tool arrow of FIG. 3) which is hydraulically displaceable in the direction indicated by the slide member arrow in FIG. 3.

Figure 3:
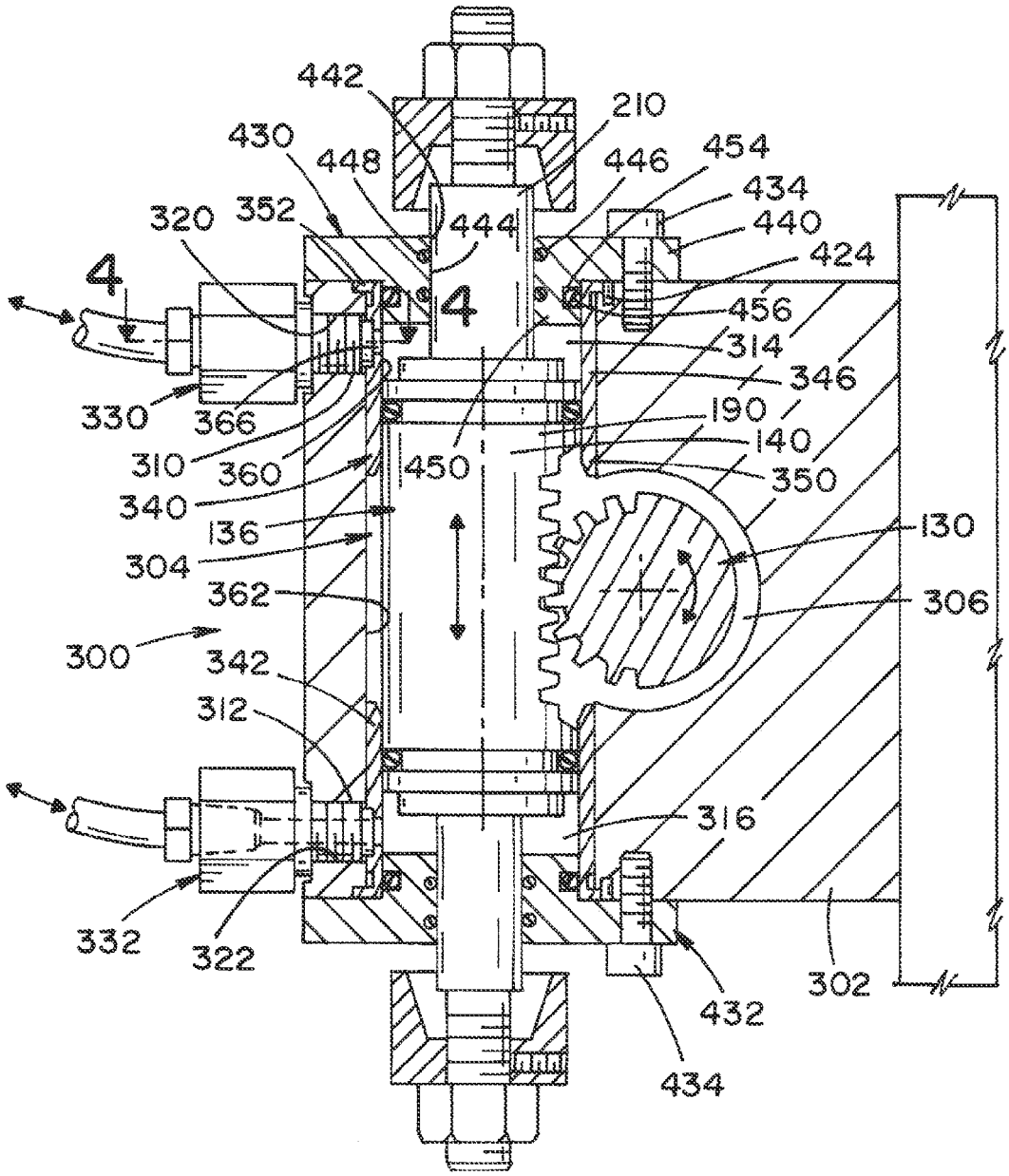
FIG. 3 is a cross-sectional view of a burnishing unit according to the present disclosure.

As depicted in FIG. 3, the burnishing unit 300 comprises a housing 302 including a first bore 304 extending therethrough along a first axis and a second bore 306 extending therethrough along a second axis that is transverse to the first axis. The piston or slide member 136 is positioned in the first bore 304 and the tool 130 is positioned in the second bore 306. The housing 302 further includes a first fluid port 310 and a second fluid port 312 spaced from the first fluid port. The first fluid port is in communication with a first end portion 314 of the first bore 304 and the second fluid port is in communication with a second end portion 316 of the first bore 304. The first fluid port 310 introduces hydraulic fluid to the first bore 304 and the second fluid port 312 allows hydraulic fluid to escape from the first bore. As shown, each of the first and second fluid ports 310, 312 is at least partially defined by an inner surface 320, 322, respectively, provided with an internal straight thread which allows for connection of an exemplary hydraulic fitting 330, 332 to the housing 302.

According to one aspect of the exemplary burnishing unit 300, a removable sleeve 340 is positioned in one of the first end portion 314 and second end portion 316 of the first bore 304. As shown, the removable sleeve 340 is a first removable sleeve positioned in the first end portion 314 of the first bore 304, and the burnishing unit 300 further includes a second removable sleeve 342 positioned in the second end portion 316 of the first bore. To accommodate the first and second removable sleeves 340, 342, the first bore 304 has an increased diameter as compared to the first bore 152. It should be appreciated that each sleeve can be at least partially formed of a material stronger (i.e., harder) than the material of the housing of the burnishing unit 300 such that the sleeves 340, 342 do not wear as easily. By way of example, the housing 302 can be formed of a first material and each sleeve 340, 342 can be formed of the first material that is plated with a second material having hardness greater than hardness of the first material. The second material can be chrome having hardness of about 68 to about 70 RC (Rockwell C scale), which is about 32 RC harder than the first material. It should also be appreciated that each sleeve 340, 342 can be completely formed of a material having hardness greater than hardness of the material of the housing 302. In the case where a sleeve 340, 342 does wear, the sleeve can be easily replaced.

It should be appreciated that the hydraulic fittings 330 and 332 and the first and second sleeves 340 and 342 may be identically constructed, but for their disposition on opposite sides of the burnishing unit 300. To simplify the explanation of the present disclosure, only the features of the hydraulic fitting 330 and the first sleeve 340 will be discussed, but it should be understood that the same construction could be used for the hydraulic fitting 332 and the first sleeve 342.

Figure 4:
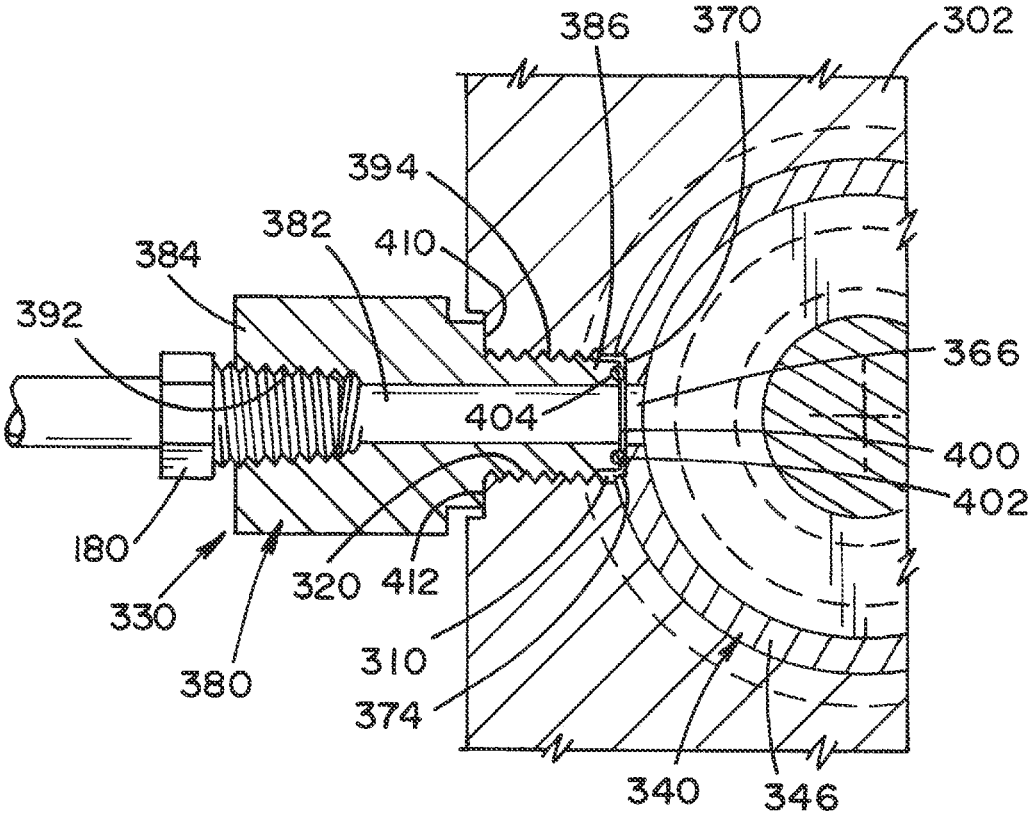
FIG. 4 is a cross-sectional view of the burnishing unit of FIG. 3 taken along line 4-4 of FIG. 3.
Figure 5:
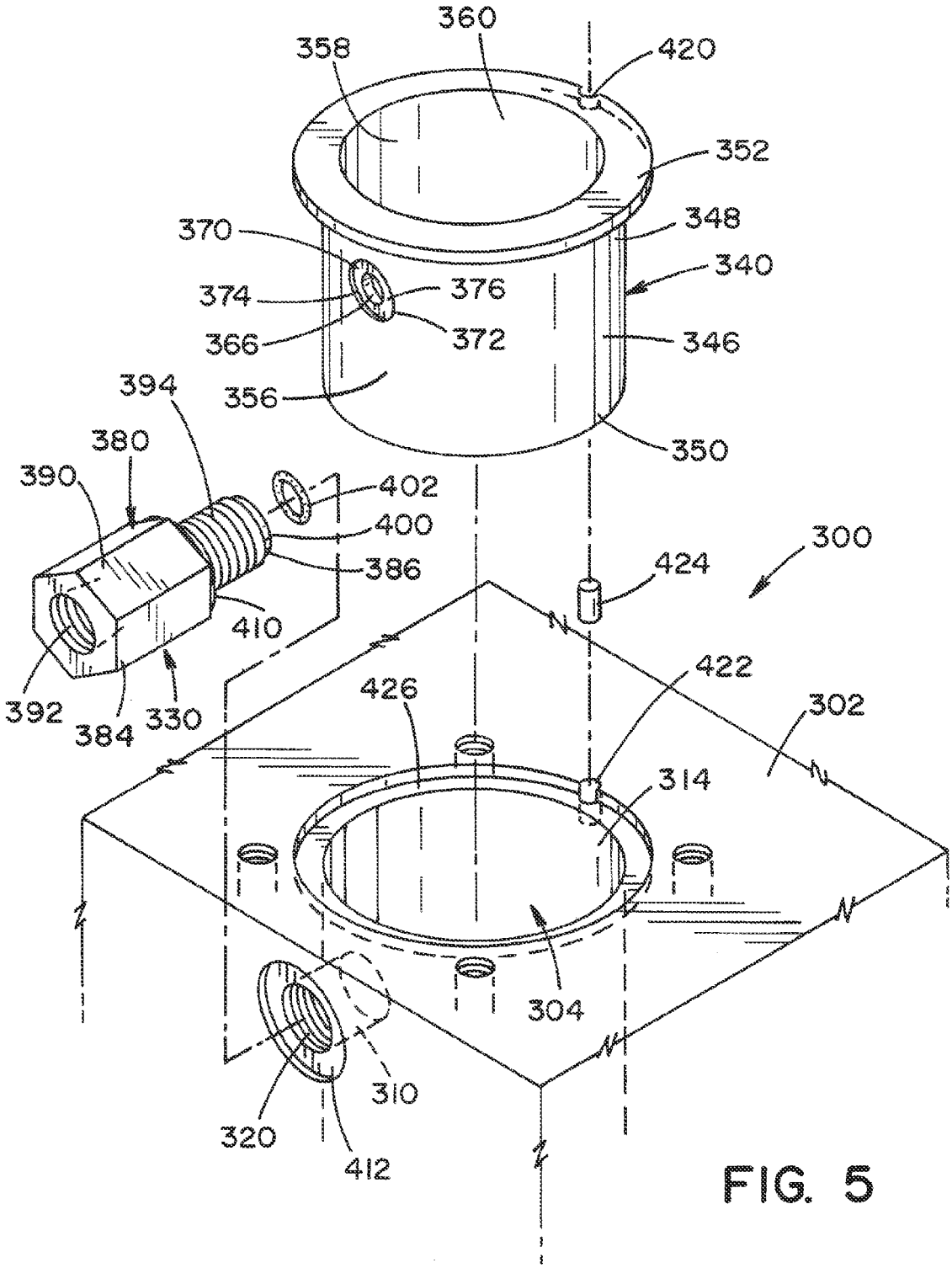
FIG. 5 is a partial exploded view of the burnishing unit of FIG. 3.

As best depicted in FIG. 5, the first sleeve 340 includes a cylindrical sidewall 346 having a first end portion 348 and a second end portion 350. An annular flange 352 is provided at the first end portion 348. The sidewall 346 has an outer surface 356 and an inner surface 358 which defines an opening 360 of the first sleeve 340 dimensioned to receive the end portion 190 of the body 140 of the slide member 136. The first sleeve 340 further includes an opening 366 in the sidewall 346 that is in communication with the first bore 304 and the first fluid port 310. More particularly, the sidewall 346 of the first sleeve 340 includes a landing 370. The landing 370 is a cutout 372 in the sidewall 346 that surrounds the opening 366 and is defined by an inwardly extending peripheral wall 374 and a substantially planar base wall 376. The opening 366 is located on the base wall 376 of the landing 370. It should be appreciated that the stroke of the slide member 136 in the first bore 304 is limited to the lengths of the first and second sleeves 340, 342 positioned in the first bore 304. As shown in FIG. 4, according to one aspect, a length of the sidewall 346 of the first sleeve 340 locates the second end portion 350 adjacent the second bore 306.

As indicated above with reference to FIGS. 1 and 2, a conventional hydraulic fitting 182 is inserted from the exterior of the burnishing unit 100 into the first fluid port 160 to provide the hydraulic fluid to the first bore 152. Because the replaceable sleeve 340 is inserted in the first bore 304 of the burnishing unit 300, a small gap can exist between an inner surface 362 of the housing 302 that defines the first bore 304 and the outer surface 356 of the first sleeve 340 that can allow hydraulic fluid to leak. Therefore, because the configuration of the hydraulic fitting 180 creates a space between the fitting and the first bore, the conventional fitting 180 cannot be used with the burnishing unit 300. Instead, the exemplary hydraulic fitting 330 is positioned in the first fluid port 310.

With reference to FIGS. 4 and 5, the hydraulic fitting 330 comprises a unitarily formed body 380, made from a hard material such as steel or stainless steel, and which has a central aperture 382 extending along the longitudinal axis of body 380. The central aperture 382 functions as a conduit for the hydraulic fluid passing through the fitting. The body 380 has a proximal end portion 384 and a distal end portion 386 adapted to sealingly engage the sidewall 346 of the first sleeve 340 around the opening 366 provided therein. The proximal end portion 384 of the body 380 includes a hexagonally shaped wrenching portion 390 that permits the fitting 330 to be installed with conventional tools such as sockets or wrenches, and includes an internal pipe thread 392 adapted to receive a conventional hydraulic fitting (e.g. hydraulic fitting 180). The distal end portion 386 of the body 380 includes an external threaded portion 394 having a straight thread 394 formed or cut on the exterior surface for threadingly engaging the inner surface 320 of the first fluid port 310. In contrast to the conventional fitting 180, the straight thread 394 of the exemplary fitting 330 allows the distal end portion 386 to thread through the entire longitudinal extent of the first fluid port 310.

The distal end portion 386 of the body 380 of the fitting 330 includes an end face 400 having a seal 402 mounted thereto. Particularly, the end face 400 includes an annular groove 404 adapted to at least partially receive the seal 402 therein, the seal being of complementary shape to the groove. However, it should be appreciated that the groove 404 may define other suitable shapes. The exterior surface of the annular seal 402 extends slightly outwardly from the end face 400. The cutout 372 on the sidewall 346 of the first sleeve 340 is sized to at least partially receive the end face 400 with the peripheral wall 374 of the landing 370 has a shape corresponding to a shape of the end face 400. This allows the fitting 330 to provide a secure, fluid-tight seal between the end face 400 and the landing 370 around the opening 366. This configuration of the exemplary hydraulic fitting 330 also allows the fitting to directly sealingly engage the sidewall 346 of the first sleeve 340 thereby preventing leakage of hydraulic fluid between an exterior of the first sleeve 340 and the first bore 304. Further, to allow for a compact design of the burnishing unit 300, the hydraulic fitting 330 includes a shoulder 410 located between the wrenching portion 390 and the threaded portion 394. The shoulder 410 is received in a counterbore 412 provided around the first fluid port 310 of the housing 302.

With reference to FIG. 5, to allow for proper positioning of the first sleeve 340 in the first bore 304, the first sleeve 340 includes a first indicator 420 and the housing 302 of the burnishing unit 300 includes a corresponding second indicator 422. Alignment of the first and second indicators 420, 422 aligns the sleeve opening 366 with the first fluid port 310. As depicted, the first indicator 420 can be in the form of a first notch located on the flange 352, and the second indicator 422 can be in the form of a second notch. According to this aspect, a pin 424 can be provided for placement in the sleeve notch 420 and the second notch 422 for maintaining the alignment of the first sleeve 340 within the first bore 310. Although, it should be appreciated that alternative manners for aligning the first sleeve 340 in the first bore 310 are contemplated. For example, the first and second indicators 420, 422 can be simple visual indicators to be aligned by an operator. Further, to provide for a flush surface of the housing 302 with the first sleeve mounted thereto, the housing 302 includes a counterbore 426 provided at the first bore 310 for receiving therein the annular flange 352.

Similar to burnishing unit 100, burnishing unit 300 includes end caps 430, 432 which are attached to the housing 302 via fasteners 434. The end caps 430, 432 cover the respective first and second end portions 314, 316 of the first bore 310. Particularly, end cap 430 comprises body 440 having an opening 442 extending therethrough. The opening 442 is sized to receive the shaft 210. An inner surface 444 of the body 440 that defines the opening includes at least one annular groove 446 having a seal 448 received therein for sealingly engaging an outer surface of the shaft 210. The body 440 further a stem 450 dimensioned to be received in the opening 360 of the first sleeve 340. The stem is provided with an annular groove 454 having a seal 456 mounted therein for sealingly engaging the inner surface 358 of the sidewall 346 of the first sleeve 340. The end cap 432 has a construction similar to end cap 430.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A burnishing unit comprising:

a tool having at least one working roller;

a housing including a bore extending therethrough, the bore has a first end portion and a second end portion, and further including a first fluid port and a second fluid port, each fluid port is in communication with the bore, the first fluid port introduces hydraulic fluid to the bore and the second fluid port allows hydraulic fluid to escape from the bore; a removable sleeve positioned in one of the first end portion and second end portion of the bore, the sleeve including a sidewall having an opening in communication with the bore and the first fluid port; and a hydraulic fitting positioned in the first fluid port, the fitting has a proximal end portion adapted to receive an associated hydraulic conduit and a distal end portion, the distal end portion adapted to sealingly engage the sidewall of the sleeve around the opening provided therein.

2. The burnishing unit of claim 1, wherein the sidewall of the sleeve includes a landing surrounding the opening.

3. The burnishing unit of claim 2, wherein the distal end portion of the fitting includes an end face having a seal mounted thereto, the end face together with the seal engaging the landing.

4. The burnishing unit of claim 3, wherein the landing is a cutout in the sidewall of the sleeve, the cutout is defined by an inwardly extending peripheral wall and a substantially planar base wall, the peripheral wall has a shape corresponding to a shape of the end face of the distal end portion.

5. The burnishing unit of claim 3, wherein the end face of the distal end portion includes an annular groove adapted to at least partially receive the seal therein.

6. The burnishing unit of claim 2, wherein the sleeve includes a first indicator and the housing includes a corresponding second indicator, alignment of the first and second indicators aligns the opening with the first fluid port.

7. The burnishing unit of claim 6, wherein the sleeve includes an annular flange and the first indicator is a notch located on the flange.

8. The burnishing unit of claim 7, wherein the second indicator is a second notch, and further including a pin for placement in the notch on the flange and the second notch for maintaining the alignment of the sleeve within the bore.

9. The burnishing unit of claim 1, wherein the proximal end portion of the fitting includes a hexagonally shaped wrenching portion having an internal pipe thread and the distal end portion of the fitting includes a threaded portion having a straight thread.

10. The burnishing unit of claim 9, wherein the fitting includes a shoulder located between the wrenching portion and the threaded portion, the shoulder received in a counterbore provided around the first fluid port of the housing.

11. The burnishing unit of claim 1, wherein the sleeve includes an annular flange and the housing includes a counterbore provided at the bore for receiving therein the annular flange.

12. The burnishing unit of claim 1, further including an end cap mounted to the housing and covering the end portion of the bore having the sleeve located therein, the end cap includes a stem, wherein the stem is positioned in the sleeve and the end cap further includes a seal mounted to the stem, the seal engaging an inner surface of the sleeve.

13. The burnishing unit of claim 1, further including a second removable sleeve positioned in the other of the first end portion and second end portion of the bore, the second sleeve including a sidewall having an opening in communication with the bore and the second fluid port.

14. A burnishing unit comprising:

a tool having at least one working roller;

a housing including a bore extending therethrough, the bore has a first end portion and a second end portion, and further including a first fluid port and a second fluid port, each fluid port is in communication with the bore, the first fluid port introduces hydraulic fluid to the bore and the second fluid port allows hydraulic fluid to escape from the bore;

a first removable sleeve positioned in the first end portion of the bore, the first sleeve including a first sidewall having a first opening in communication with the bore and the first fluid port;

a second removable sleeve positioned in the second end portion of the bore, the second sleeve including a second sidewall having a second opening in communication with the bore and the second fluid port; and a hydraulic fitting mounted in the first fluid port, the fitting has a proximal end portion adapted to receive an associated hydraulic conduit and a distal end portion having an end face, the end face of the distal end portion adapted to sealingly engage the first sidewall of the first sleeve around the first opening provided therein to prevent leakage of hydraulic fluid between an exterior of the sleeve and the bore.

15. The burnishing unit of claim 14, wherein the first sidewall of the first sleeve includes cutout surrounding the first opening, the cutout sized to at least partially receive the end face of the distal end portion of the fitting.

16. The burnishing unit of claim 15, wherein the cutout is defined by an inwardly extending peripheral wall and a substantially planar base wall, the first opening located on the base wall, the peripheral wall has a shape corresponding to a shape of the end face of the distal end portion.

17. The burnishing unit of claim 14, wherein the first sleeve defines a first length and the second sleeve defines a second length, and the burnishing unit further includes a piston having a stroke limited the first and second lengths of the first and second sleeves.

18. The burnishing unit of claim 14, wherein the first sleeve includes an annular flange having a first indicator and the housing includes a corresponding second indicator, alignment of the first and second indicators aligns the first opening with the first fluid port, and the first indicator is a notch located on the flange.

19. The burnishing unit of claim 14, wherein the proximal end portion of the fitting includes a hexagonally shaped wrenching portion having an internal pipe thread and the distal end portion of the fitting includes a threaded portion having a straight thread, and further including a shoulder located between the wrenching portion and the threaded portion, the shoulder received in a counterbore provided in the housing around the first fluid port, and wherein the distal end portion of the fitting includes an annular groove adapted to at least partially receive an annular seal therein.

20. A burnishing unit comprising:

a tool having at least one working roller;

a housing including a bore extending therethrough, the bore has a first end portion and a second end portion, and further including a first fluid port and a second fluid port, each fluid port is in communication with the bore, the first fluid port introduces hydraulic fluid to the bore and the second fluid port allows hydraulic fluid to escape from the bore;

a removable sleeve positioned in one of the first end portion and second end portion of the bore, the sleeve including a sidewall having a cutout defined by an inwardly extending peripheral wall and a substantially planar base wall, and further including an opening located on the base wall, the opening in communication with the bore and the first fluid port, wherein the sleeve includes an annular flange having a first indicator and the housing includes a corresponding second indicator, alignment of the first and second indicators aligns the sleeve opening with the first fluid port; and a hydraulic fitting having a hexagonally shaped wrenching proximal end portion having an internal pipe thread for an associated hydraulic conduit and a distal end portion having an external thread for mounting the fitting in the first fluid port, the distal end portion has an end face including an annular groove adapted to at least partially receive an annular seal therein, the end face of the distal end portion adapted to sealingly engage the base wall of the sleeve around the opening to prevent leakage of hydraulic fluid between an exterior of the sleeve and the bore.

* * * * *